US007587906B2

(12) United States Patent
Estes et al.

(10) Patent No.: US 7,587,906 B2
(45) Date of Patent: Sep. 15, 2009

(54) ADAPTIVE DEFROST CONTROL CIRCUIT WITH RELAY POWER SAVING FEATURE

(75) Inventors: Bay Estes, Palatine, IL (US); Leonard W. Jenski, Roselle, IL (US)

(73) Assignee: Robertshaw Controls Company, Carol Stream, IL (US)

( * ) Notice: Subject to any disclaimer, the term of this patent is extended or adjusted under 35 U.S.C. 154(b) by 646 days.

(21) Appl. No.: 11/371,482

(22) Filed: Mar. 9, 2006

(65) Prior Publication Data

US 2007/0209375 A1 Sep. 13, 2007

(51) Int. Cl.
*F25D 21/06* (2006.01)
*F25D 21/00* (2006.01)

(52) U.S. Cl. ..... 62/151; 62/80; 62/155

(58) Field of Classification Search ..... 62/151, 62/155, 127, 128, 234
See application file for complete search history.

(56) References Cited

U.S. PATENT DOCUMENTS 6,014,325 A * 1/2000 Pecore ..... 363/126
6,772,597 B1 * 8/2004 Zentner et al. ..... 62/80
2004/0244389 A1 * 12/2004 Denvir ..... 62/156

* cited by examiner

*Primary Examiner*—Albert W Paladini
*Assistant Examiner*—Dharti Patel
(74) *Attorney, Agent, or Firm*—Reinhart Boerner Van Deuren P.C.

(57) ABSTRACT

A defrost heater relay control circuit having reduced power consumption during a de-energized mode of operation is provided. The relay drive circuit utilizes a series connected capacitor to introduce a phase shift in the AC current waveform such that the amount of real power dissipated in the circuit during periods when the defrost heater control relay is de-energized is greatly reduced. This effectively shorts out the relay drive voltage without generating heat due to real power dissipation through the switched circuitry that disables the relay.

19 Claims, 5 Drawing Sheets

ADAPTIVE DEFROST CONTROL CIRCUIT WITH RELAY POWER SAVING FEATURE

FIELD OF THE INVENTION

The present invention relates generally to defrost control circuitry for consumer and commercial refrigeration appliances, and more particularly to power reduction circuitry for use with such defrost control systems.

BACKGROUND OF THE INVENTION

Recognizing that icing of the evaporator heat exchanger in a consumer or commercial refrigeration unit, such as a refrigerator or freezer, many modern appliances provide fixed or adaptive defrost control. Such a defrost control provides heating of the evaporator heat exchanger so as to melt any accumulated frost or ice that may have formed thereon during the refrigeration cooling cycle. Many different methods of controlling the defrost cycle are known in the art, including electromechanical timers and microprocessor control.

Typically, such defrosting circuitry employs a heater positioned in proximity to the evaporator heat exchanger within the freezer compartment of the refrigerator or freezer. At controlled intervals while the refrigeration system is not operating during its normal temperature control cycle, the defrost heater is energized. This defrost heater generates enough heat to cause melting of the frost build up or ice on the evaporator heat exchanger, which greatly increases the efficiency of subsequent cooling cycles.

While providing a defrost heater greatly enhances the overall efficiency of the refrigeration cycle, the heat generated by the defrost heater will have to be removed in subsequent cooling cycles to maintain the interior temperature of the freezer compartment. A simple rule of thumb is that twice the amount of energy is needed to remove a unit of heat. As such, heat generation within the freezer compartment must be minimized both during the defrost cycle, and when the defrost heater is not energized.

Electromechanical defrost timers and modern adaptive defrost controls operate to provide such limited heating only when necessary and only to the extent necessary to accomplish the defrosting of the evaporator heat exchanger. During other periods, the defrost heater is turned off, although the defrost heater control circuitry is still powered. Unfortunately, even when the defrost heater is turn off, this control circuitry still generates a small amount of heat due to the consumption of the standby power by the control circuitry when not in the defrost mode of operation. While small, this heat generated must still be removed during subsequent cooling cycles. As a result, the overall efficiency is decreased and the cost of ownership of the appliance is increased.

There exists, therefore, a need in the art for a refrigeration defrost control circuit that reduces the amount of heat generated while in this standby mode of operation when the defrost heater is not energized. The circuitry of the present invention provides such power reduction.

These and other advantages of the invention, as well as additional inventive features, will be apparent from the description of the invention provided herein.

BRIEF SUMMARY OF THE INVENTION

The present invention provides a new and improved defrost heater control circuit that overcomes one or more problems existing in the art. More particularly, the present invention provides a new and improved defrost control circuit that reduces the heat generated during a standby mode of operation when the defrost heater is not operated. Still more particularly, the present invention provides a new and improved defrost heater control circuit that reduces the amount of real power consumed during a standby mode of operation to therefore reduce the amount of heat generated during such mode.

In one embodiment of the present invention the defrost heater control circuit includes a relay to switch power to the defrost heater, and a relay drive circuit. In this embodiment the relay drive circuit utilizes a twenty four volt supply to energize the relay, which connects the heater power supply to the heater element to provide the defrost mode of operation. However, when the relay is turned off, the circuit of the present invention saves real power by effectively shorting out the relay power supply.

In a preferred embodiment of the present invention, the defrost control circuit provides a capacitor in series with the line AC voltage to act as a dropping impedance. While this would apparently increase the current to the drive circuit when the relay is off, due to the increased voltage across the capacitor, the result is that the power dissipated across the circuit is primarily reactive, i.e., not real power that would be turned into heat. As a result the amount of heat generated by the circuit when the relay for the defrost heater is held off is substantially reduced.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
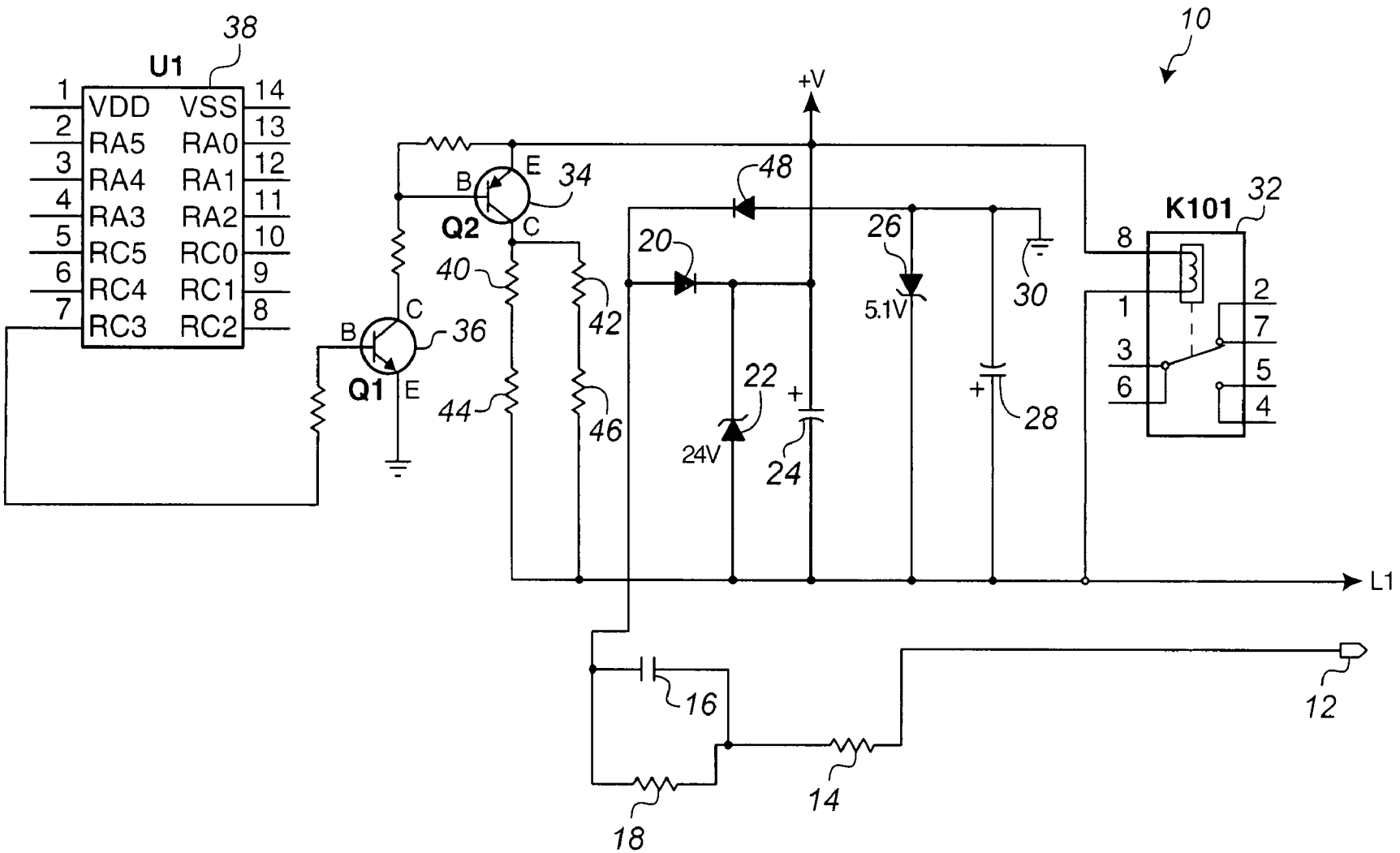
FIG. 1 is a simplified single line schematic diagram of one embodiment of a defrost heater control circuit constructed in accordance with the teachings of the present invention.

FIG. 1 illustrates one embodiment of a defrost heater relay drive circuit 10 constructed in accordance with the teachings of the present invention. This circuit 10 controls the on or off state of the defrost heater (not shown) in, for example, a consumer or commercial refrigerator and/or freezer. An advantage provided by the circuit of FIG. 1 is that the real power dissipation, and therefore heat generation, during periods when the defrost heater is de-energized is greatly reduced compared with other defrost heater relay drive circuits. Since approximately twice the amount of energy is needed to remove a unit of heat from the refrigeration compartment, any reduction in heat generated during periods when the defrost heater is not to be energized greatly enhances the efficiency of the system and reduces the overall cost of operation and lifetime costs of ownership of the appliance.

As illustrated in FIG. 1, the power for the circuit is taken from the line voltage via power terminal 12. A transient limiting resistor 14 couples the terminal 12 to a node between a parallel combination of capacitor 16 and resistor 18. This parallel combination is coupled to the anode of diode 20 and the cathode of diode 48. The cathode of diode 20 is connected to a parallel combination of Zener diode 22 and capacitor 24. In the illustrated embodiment, this combination forms the twenty four volt supply to operate the defrost heater drive relay 32.

This parallel combination is then coupled to another parallel combination of Zener diode 26 and capacitor 28, which are then coupled to ground 30. This second parallel combination provides the five volt supply for use by the controller 38 and other control circuitry. The anode of diode 48 is also coupled to this ground connection 30. One terminal of the coil of the defrost heater drive relay 32 is coupled between the two Zener diodes 22, 26. The other terminal of the coil of the relay 32 is coupled to a node that connects the cathode of the Zener diode 22, diode 20, and positive terminal of capacitor 24.

This node also connects to the emitter of transistor 34. The collector of transistor 34 is coupled through the resistor network 40, 42, 44, 46 to the node between Zener diodes 22, 26. The base of transistor 34 is coupled through a resistor to the collector of transistor 36. The emitter of this transistor 36 is coupled to ground, while the base is coupled through a resistor to a controller 38. As will be discussed more fully below, this controller 38 operates to energize or de-energize the relay 32 through the control circuit 10.

In the discussion that follows, operation of the circuit 10 will be described for both the condition when the relay 32 is energized to provide power to the defrost heater to initiate and maintain a defrost cycle, and the condition when the relay 32 is de-energized to stop the defrost cycle. Since power is derived from the AC line voltage, the discussion will cover two situations for each condition. The first operation that will be discussed will be during the positive half cycle of the line voltage, followed by a discussion of the operation of the circuit during the negative half cycle of the line voltage. In each of these conditions, reference will be made to an additional line superimposed on the schematic illustrating the primary current flow during the various conditions.

Figure 2:
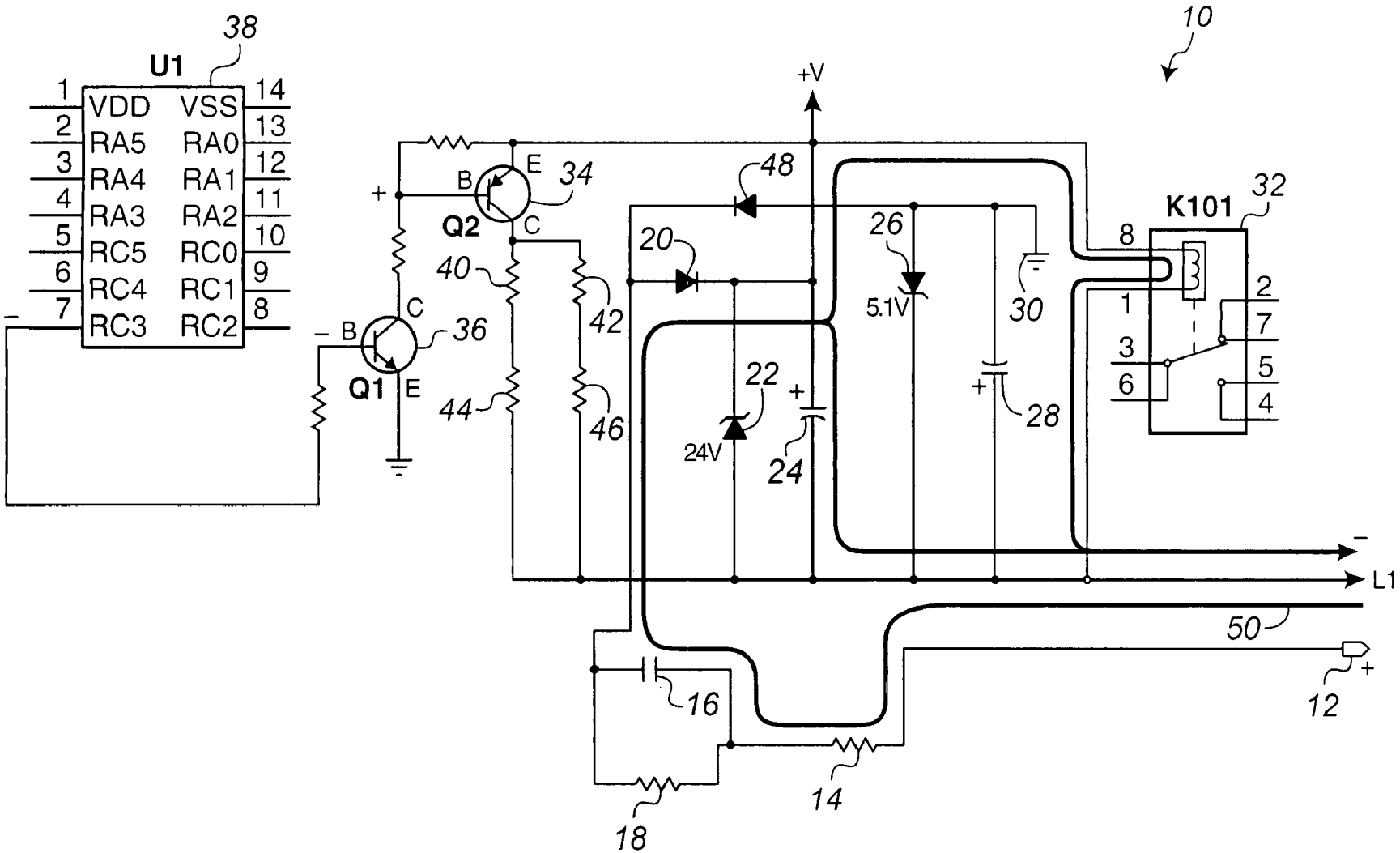
FIG. 2 is a simplified single line schematic diagram of the circuit of FIG. 1 illustrating current flow during a positive half cycle of the line voltage while the defrost heater relay is energized.

FIG. 2 illustrates the primary current flow 50 while the relay is energized during the positive half cycle of the AC line voltage coupled to terminal 12. This current flow 50 will flow through the transient limiting resistor 14 and primarily through the series connected capacitor 16, due to the relative impedance to the AC line voltage between capacitor 16 and resistor 18. This current will flow through the diode 20 and will charge capacitor 24 to the clamped voltage dictated by Zener diode 22. In one embodiment of the present invention this voltage is clamped at twenty four volts.

The current through diode 20 will also flow through the coil of relay 32 to energize this relay 32 to start the defrost cycle. The current will then flow to the L1 terminal. This primary current flow path exists when the controller 38 has a low output to the transistor 36. This low output maintains transistor 36 in an off state. As a result, the voltage at the base of transistor 34 is positive, which keeps transistor 34 also in an off state. In this state, no current can flow through transistor 34.

Figure 3:
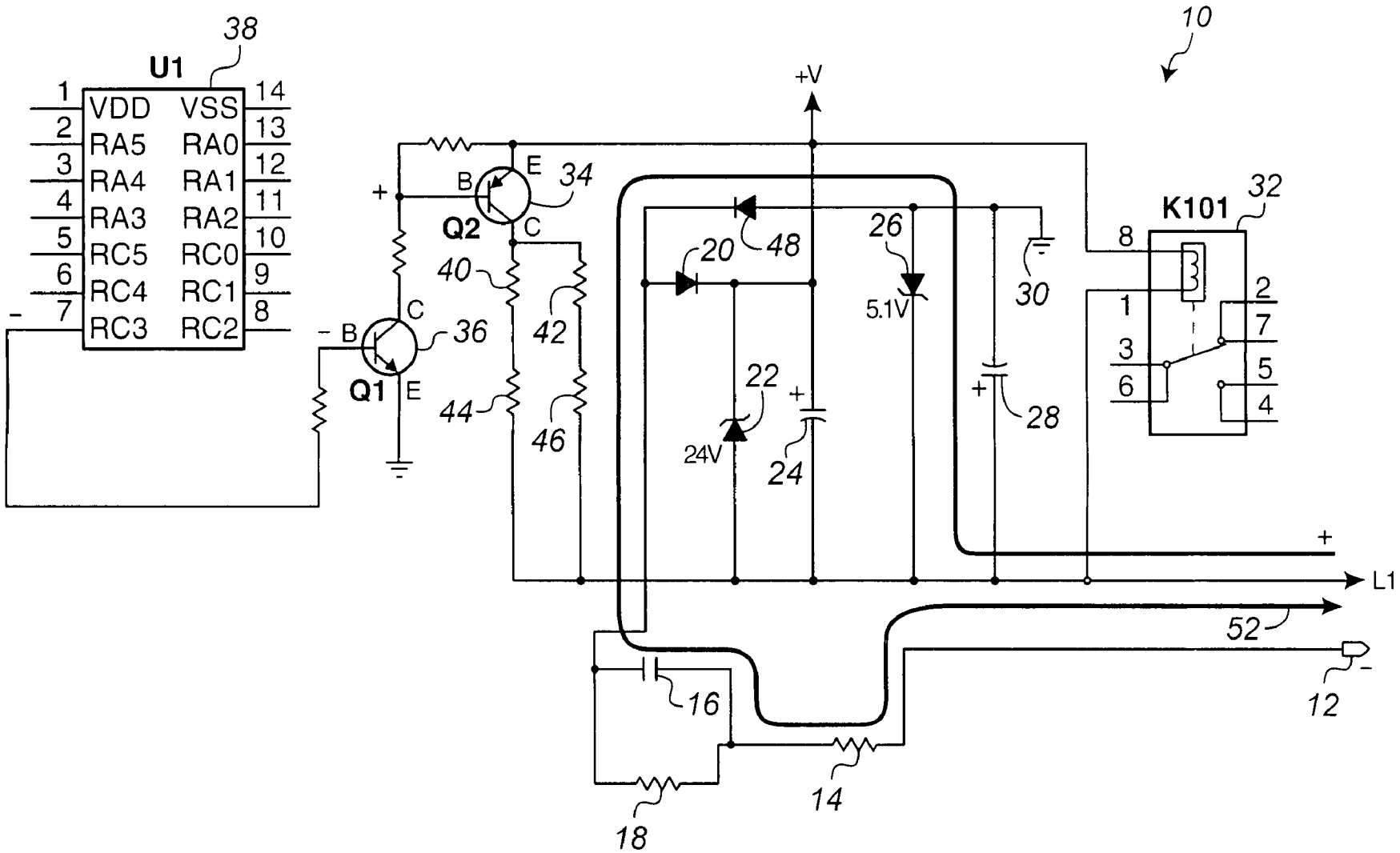
FIG. 3 is a simplified single line schematic diagram of the circuit of FIG. 1 illustrating current flow during a negative half cycle of the line voltage while the defrost heater relay is energized.

During the negative half cycle as illustrated in FIG. 3, the controller maintains the same output to transistor 36 which also maintains transistor 34 in the off state. During this negative half cycle current flows in the opposite direction from the L1 terminal though the capacitor 28. The voltage developed across capacitor 28 will be clamped by the Zener diode 26. In one embodiment of the present invention this voltage is clamped to approximately five volts for use by the controller 38. The current then flows through diode 48, capacitor 16 and transient suppression resistor 14 to terminal 12 as illustrated by line 52. The relay 32 is kept energized by the discharge of capacitor 24 through the coil of relay 32 during this negative half cycle.

As the AC line voltage again transitions to a positive half cycle, current flow as illustrated by line 50 of FIG. 2 will again occur. As a result of this cyclical operation, the relay 32 will continue to be energized during the defrost cycle to provide power to the defrost heater.

Figure 4:
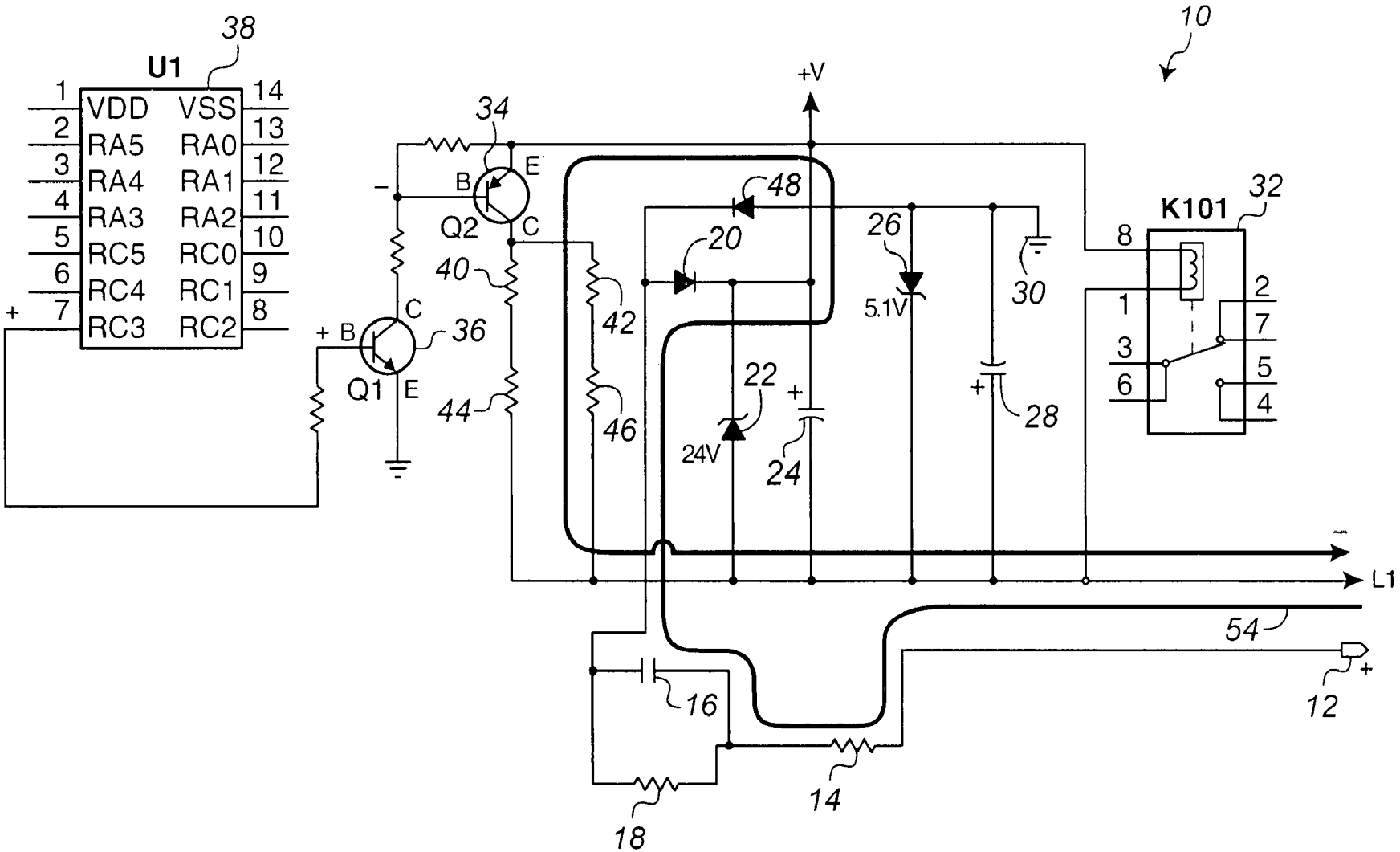
FIG. 4 is a simplified single line schematic diagram of the circuit of FIG. 1 illustrating current flow during a positive half cycle of the line voltage while the defrost heater relay is off.

Once the controller 38 has determined that the defrost cycle is to be ended, the controller 38 provides a positive output to transistor 36 as illustrated in FIG. 4. This positive output turns on transistor 36, which then pulls the base of transistor 34 low. As a result, transistor 34 turns on to allow current flow therethrough. While in this condition, during the positive half cycle of the AC line voltage connected to terminal 12, the primary current flow will be as illustrated by line 54.

Specifically, current will flow from the terminal 12 through the resistor 14 and capacitor 16, through diode 20 transistor 34 and the resistor network 40-46. The current will continue to flow to the L1 terminal. The result of this operation is that the voltage supplied to the coil of relay 32 is pulled down through transistor 34 such that it is below the drop out voltage of the relay 32. As a result, the relay 32 becomes de-energized and the voltage to the defrost heater is turned off.

During this state the current flows through the resistor network 40-46. If this current flow were in phase with the line voltage, the power dissipation across this resistor network would be real, and would result in the generation of heat. However, as discussed above, the generation of heat during periods other than the defrost cycle would decrease the efficiency of the system based on the increased load on the refrigeration system to remove this heat from the freezer compartment. However, since the current flows through capacitor 16, a phase shift in the current occurs such that the real power dissipated across the resistor network is reduced. In other words, the inclusion of capacitor 16 results in the power dissipated being reactive power, not real power that would otherwise be turned into heat. This reduction in heat generation provides a significant advantage over prior defrost drive circuits that consumed standby power and generated heat when not in the defrost mode.

Figure 5:
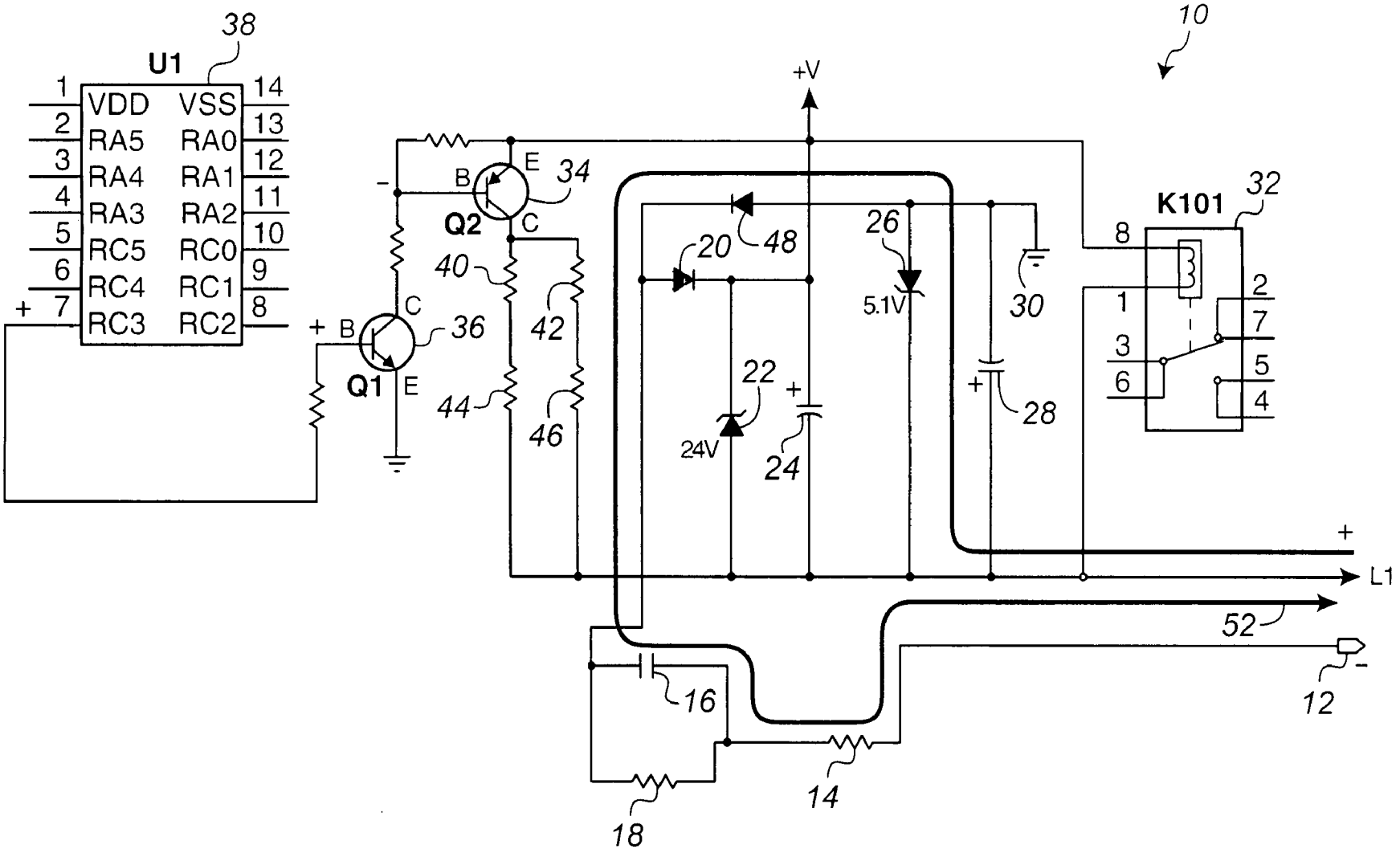
FIG. 5 is a simplified single line schematic diagram of the circuit of FIG. 1 illustrating current flow during a negative half cycle of the line voltage while the defrost heater relay is off.

When the AC line voltage is in its negative half cycle, the current flows as illustrated by line 56 in FIG. 5. This primary current flow goes from the L1 terminal through capacitor 28 (and Zener diode 26 once the voltage reaches the clamping voltage), through diode 48, capacitor 16 and transient suppression resistor 14 to the AC line terminal 12. During this negative half cycle, the relay 32 is also not energized, which maintains the defrost heater in an off condition.

As will now be apparent to those skilled in the art in view of the foregoing disclosure, inclusion of the series capacitor effectuates a phase shift of the current waveform relative to the voltage waveform such that the amount of real power dissipated in the form of heat is greatly reduced or eliminated. As a result, this drive circuit minimizes the heat generated during the standby mode of operation for the defrost heater so as to not increase the load on the refrigeration system. As a result, the overall efficiency of the entire system is increased, which results in a reduced cost of operation and lifetime cost of ownership.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A relay drive circuit for switching a defrost heater control relay comprising:

an input adapted to receive an alternating current (AC) voltage;

a reactive element coupled in line with the input;

a first clamping circuit coupled to the reactive element, the output of the first clamping circuit adapted to be coupled to a first terminal of a control coil of the defrost heater control relay; and a switching circuit coupled to the output of the first clamping circuit, the switching circuit operable to null down a voltage of the first clamping circuit when activated;

wherein the reactive element is a capacitor; and wherein the switching circuit includes at least one resistive element through which the voltage of the clamping circuit is pulled down.

2. The circuit of claim 1, wherein the capacitor introduces a phase shift of current flowing through the at least one resistive element so as to reduce an amount of real power dissipated thereby.

3. The circuit of claim 1, wherein the switching circuit comprises at least two transistors and a resistor network coupled to a defrost cycle controller.

4. The circuit of claim 1, further comprising a second clamping circuit coupled to a negative node of the first clamping circuit and adapted to be coupled to a second terminal of the control coil of the defrost heater control coil.

5. The circuit of claim 4, wherein the second clamping circuit is adapted to provide a 5 volt voltage output.

6. The circuit of claim 1, further comprising a transient voltage suppression element coupled in line with the reactive element.

7. The circuit of claim 1, wherein the first clamping circuit is adapted to be charged during a positive half cycle of the AC voltage, and wherein the first clamping circuit provides power to the first terminal of the control coil of the defrost heater control coil during a negative half cycle of the AC voltage when the switching circuit is not activated.

8. The circuit of claim 1, further comprising a first steering diode coupled between the reactive element and the first clamping circuit, and a second steering diode coupled between the reactive element and a return terminal.

9. The circuit of claim 8, wherein the reactive element is coupled to the anode of the first steering diode and to the cathode of the second steering diode.

10. A drive circuit for controlling energization of a defrost heater; comprising:

an input adapted to receive an alternating current (AC) voltage;

a capacitor coupled in parallel with a resistor, and coupled in line with the input;

a first energy storage element coupled to the capacitor;

a defrost heater control relay coupled to the first energy storage element;

a switching circuit coupled to the first energy storage element;

an energy dissipation circuit coupled to the switching circuit, wherein the energy dissipation circuit includes a plurality of resistive elements through which the voltage of the first energy storage element is pulled down; and a defrost cycle controller coupled to the switching circuit, the defrost cycle controller configured to activate the switching circuit disable the defrost heater control relay.

11. The circuit of claim 10, wherein the capacitor is operable to introduce a phase shift of current flowing through the energy dissipation circuit so as to reduce an amount of real power dissipated thereby.

12. The circuit of claim 11, further comprising a transient suppression resistor coupled in line with the input prior to the capacitor.

13. The circuit of claim 10, further comprising a second energy storage element coupled between the first energy storage element and a return.

14. The circuit of claim 13, further comprising a Zener diode coupled in parallel with the second energy storage element to limit a voltage thereacross to approximately five volts.

15. The circuit of claim 10, further comprising a first steering diode coupled between the capacitor and the first energy storage element, and a second steering diode coupled between the capacitor and the return, and wherein the capacitor is coupled to the anode of the first steering diode and to the cathode of the second steering diode.

16. The circuit of claim 10, wherein the capacitor is operable to introduce a phase shift of current flowing through the energy dissipation circuit so as to reduce an amount of heat generated thereby.

17. The circuit of claim 10, further comprising a Zener diode coupled in parallel with the first energy storage element to limit a voltage thereacross to approximately twenty four volts to drive the defrost heater control relay.

18. The relay drive circuit of claim 1, wherein the reactive element is coupled in parallel with a resistive element.

19. The drive circuit of claim 10, wherein the switching circuit comprises a first transistor and a second transistor, wherein the collector of the first transistor is coupled to the base of the second transistor.

* * * * *